US010806270B2

(12) United States Patent
Gerhard

(10) Patent No.: US 10,806,270 B2
(45) Date of Patent: Oct. 20, 2020

(54) SPACE SAVING BED

(71) Applicant: Daniel Gerhard, Munich (DE)

(72) Inventor: Daniel Gerhard, Munich (DE)

( * ) Notice: Subject to any disclaimer, the term of this patent is extended or adjusted under 35 U.S.C. 154(b) by 153 days.

(21) Appl. No.: 15/966,175

(22) Filed: Apr. 30, 2018

(65) Prior Publication Data

US 2018/0332974 A1 Nov. 22, 2018

(30) Foreign Application Priority Data

May 17, 2017 (EP) ..... 17171509

(51) Int. Cl.
*A47C 19/20* (2006.01)
*A47C 17/32* (2006.01)

(52) U.S. Cl.
CPC ..... *A47C 19/202* (2013.01); *A47C 17/32* (2013.01)

(58) Field of Classification Search
CPC ..... A47C 17/32; A47C 19/202
USPC ..... 5/8, 9.1
See application file for complete search history.

(56) References Cited

U.S. PATENT DOCUMENTS 257,856 A * 5/1882 Fischbeck ..... A47C 17/32 5/22
372,891 A * 11/1887 Brooks ..... A47C 17/32 5/56
378,455 A * 2/1888 Morse ..... A47D 7/03 5/11
431,002 A * 6/1890 Morris ..... A47C 17/32 5/26.1
529,644 A * 11/1894 Clark ..... A47C 17/32 5/20
665,189 A * 1/1901 Daschbach ..... A47C 17/32 5/22
673,313 A * 4/1901 Bedell ..... A47C 17/32 5/27
984,699 A * 2/1911 Plunkett ..... A47C 17/32 5/18.1
1,506,416 A * 8/1924 Dewey ..... A47C 17/32 5/29
1,597,849 A * 8/1926 Weber ..... A47C 17/32 5/31

(Continued)

FOREIGN PATENT DOCUMENTS

DE 189525 10/1906
DE 20111592 10/2001

(Continued)

*Primary Examiner* — Myles A Throop
(74) *Attorney, Agent, or Firm* — Sand, Sebolt & Wernow Co., LPA

(57) ABSTRACT

A space saving bed of the kind that can be changed from a single bed into a double bed and vice versa and where performing this change between the single bed and double bed is easy, effortless, and does not require removal of a pad or mattress. The space saving bed includes a first frame part and a second frame part. The first frame part includes a first mattress receiving device and the second frame part includes a second mattress receiving device. The first and second frame parts are hingedly connected together about a first axis and are foldable relative to each other about the first axis. The second mattress receiving device is connected to the second frame part to be rotatable or pivotable about a second axis. The first and second axes are arranged parallel to one another.

10 Claims, 4 Drawing Sheets

(56) References Cited

U.S. PATENT DOCUMENTS

| | | | | | |
|---|---|---|---|---|---|
| 1,824,773 | A * | 9/1931 | Duvall | A47C 17/32 | 5/22 |
| 1,907,526 | A * | 5/1933 | Englander | A47C 17/32 | 5/22 |
| 1,995,787 | A * | 3/1935 | Weinman | A47C 17/32 | 5/26.1 |
| 3,594,832 | A * | 7/1971 | Bryks | A47C 19/205 | 5/9.1 |
| 4,259,756 | A * | 4/1981 | Pace | A61G 7/1046 | 5/425 |
| 5,038,422 | A * | 8/1991 | Messina | A47C 17/32 | 5/12.1 |
| 7,444,691 | B2 * | 11/2008 | Gardner | B60P 3/39 | 296/190.02 |

FOREIGN PATENT DOCUMENTS

| | | |
|---|---|---|
| GB | 202616 | 12/2004 |
| GB | 2402616 | 12/2004 |
| WO | 2013131946 | 9/2013 |

* cited by examiner

SPACE SAVING BED

The present invention relates to a space saving bed.

Numerous space saving beds and the most varied embodiments thereof are known from prior art. Also known from prior art are devices with which a couch can be changed into a bed and vice versa.

The present invention particularly relates to a space saving bed of the kind that can be changed from a single into a double bed and vice versa.

Stackable bed frames are known with respect to this type of space saving beds, for example. It is also known to foldably connect bed frame parts that are stacked on top of one another along a longitudinal edge, such that the top frame part can be folded away to the side. When in use, a single bed is changed into a double bed by first removing an upper mattress of an upper bed frame part, then folding the top bed frame part to the side next to the bottom bed frame part, and placing the mattress that was removed back onto the folded bed frame part. Folding away the top bed frame part reveals the mattress disposed in the bed frame part underneath. This results in changing the single bed into a double bed with two mattresses arranged next to one another. In a device like this, it is disadvantageous, however, that the mattress has to be removed first and then put back after folding the frame part. Furthermore, the support area of the top bed frame part must be configured for supporting the mattress on both its sides. It is therefore the object of the present invention to provide a space saving bed and/or a respective bed frame with or without pads, for example, mattresses, which can be changed from a single bed into a double bed and vice versa, wherein performing the change is particularly easy, effortless, and particularly does not require removal of a pad, particularly a mattress.

This object is achieved by a space saving bed or bed frame that comprises a first bed frame part and a second bed frame part, wherein the first bed frame part comprises a first mattress receiving device and/or a first holder for a first mattress receiving device. A mattress receiving device may particularly include, or be formed by, a slatted frame. A holder for a mattress receiving device can for example be formed by respective support elements, such as pieces of wood onto which a slatted frame can be placed as mattress receiving device.

Furthermore, the second frame part is also configured to include a second mattress receiving device and/or a second holder for a second mattress receiving device.

According to the invention the first and the second frame parts are connected such that they can folded onto each other about a first axis. This can for example be achieved by respective hinges. According to the invention, the bed frame is designed such that the second holder and/or the second mattress receiving device is connected to the second frame part to be rotatable or pivotable about a second axis. The first and second axes are arranged in parallel.

The two parallel axes make it possible to change the bed frame from a single to a double bed without removing the mattress. Furthermore, the parallel arrangement of the first and the second axes allows a particularly easy, effortless change without risking injury. This is particularly true if the frame part can be folded over with as little change in height of the second axis as possible.

Particularly advantageously, a first pad, particularly a mattress, is disposed on the first mattress receiving device and/or a second mattress is disposed on the second mattress receiving device.

The connection between the first frame part and the second frame part can advantageously be implemented by at least two hinges, which make the second frame part foldable relative to the first frame part. The first axis is particularly advantageously disposed on an edge of the first frame part.

The rotating and/or pivoting movement about the second axis can be implemented, for example, by at least one, particularly two ball bearings, also linear motion ball bearings, which allow rotation about the second axis. Particularly, the bed frame comprises two ball bearings, which allow rotation and/or pivoting about the second axis and which are disposed having an rotational axis on the second axis, and extend more than 1 cm, particularly more than 3 cm, in the direction of the second axis. Particularly, at least two ball bearings are disposed opposite one another on the second frame part. They are particularly disposed on a head end and a foot end of the frame part, respectively. The head end and foot end of a frame part are the ends or sides of a frame part representing the short sides, particularly for rectangular frame parts.

Frame parts are rectangular if they have a rectangular cross section parallel to the lying surface, the bottom and/or the mattress receiving device.

The first and the second frame parts are particularly advantageously connected such that they can be folded by at least 180°, particularly by exactly 180°, about the first axis.

The first axis is particularly advantageously disposed on an edge, particularly a longitudinal edge, of the first frame part and on an edge, particularly a longitudinal edge, of the second frame part.

The second axis particularly advantageously intersects centrally with the width of the second holder and/or the second mattress receiving device and/or the second frame part. Such an arrangement of the second axis, particularly parallel to the longitudinal extension of the mattress receiving device, to the longitudinal extension of the lying surface, and/or to the longitudinal extension of the frame part on the one hand and/or centrally in relation to the width of the frame part, the mattress receiving device, the holder and/or the lying surface on the other hand, allows a particularly effortless and easy change. If in such an arrangement the second frame part is folded down from the first frame part, the height of the second axis changes relatively little, thereby requiring a relatively little effort to effect the change from single to double and back.

Furthermore advantageously, the second axis may be movable along a length between a side of the second frame part facing the first axis and a center of the frame part, of the mattress receiving device, of the holder, and/or of the lying surface in relation to the width of the frame part, of the mattress receiving device, of the holder, and/or of the lying surface to implement an even more effortless and easy change. The second axis is particularly arranged parallel to the longitudinal extension of the mattress receiving device, to the longitudinal extension of the lying surface, and/or to the longitudinal extension of the frame part.

The orientation of the holder and/or mattress receiving device and/or mattress of the second frame part in space can remain unchanged due to the rotation and/or potential rotation about the second axis, while the second frame part is being folded, or the bed frame and/or space saving bed is changed from a single into a double bed and vice versa.

Accordingly, it is preferred that the orientation of the mattress receiving devices and/or holders and/or lying surfaces or mattresses supported by them is unchanged in a first position in which the mattress receiving devices, holders, and/or frame parts are arranged one top of one another and in a second position in which the frame parts, the mattress receiving devices, and/or holders are arranged adjacent to one another. This means that the top sides of the holders, mattress receiving devices, and/or mattresses are identical in the first position and in the second position. The position of the mattress receiving devices, holders, and/or mattresses is of course not identical but changes when the bed frame is changed. The first and second holders, first and second mattress receiving devices, and/or first and second mattresses retain their orientation in space in both positions. The specialty is that this can particularly also be ensured for the second holder, the second mattress receiving device, and/or the second mattress. The orientation of the holders, mattress receiving devices, and/or mattresses while switching from the first to the second position is particularly advantageously constant and/or it is possible to keep the orientation constant during the switch.

The bed frame particularly advantageously comprises a device for automatic rotation of the second holder and/or the second mattress receiving device about the second axis relative to the second frame part when folding the frame parts relative to one another about the first axis, particularly when switching between the first and second positions, particularly in such a manner that the second mattress receiving device and/or holder retains its orientation in space and/or relative to the first mattress receiving device, the first holder, and/or the first frame part during folding and/or switching from the first to the second position and vice versa.

The bed frame particularly advantageously also comprises at least one locking device for releasable fixing of the second holder and/or the second mattress receiving device relative to the second frame part, particularly at least in the second position, preferably however also in the first position.

The bed frame particularly advantageously comprises wheels, particularly four wheels. Particularly advantageously, at least two, particularly two wheels can be locked. The wheels are particularly advantageously disposed on the first frame part such that they are invisible from outside. The lockable wheels and/or two wheels are particularly advantageously arranged such that they are covered by a drawer front panel of the first frame part. The lockable wheels and/or two wheels are particularly arranged such that they are accessible by moving a drawer front panel of the first frame part.

A potential embodiment and other advantageous features will be illustrated purely as examples and in a non-limiting manner based on the following schematic drawings. Wherein.

The figures show a bed frame comprising two frame parts 1, 2. The frame parts 1, 2 each comprise a slatted frame 5, 6 and mattresses 3, 4 placed thereon.

Figure 1:
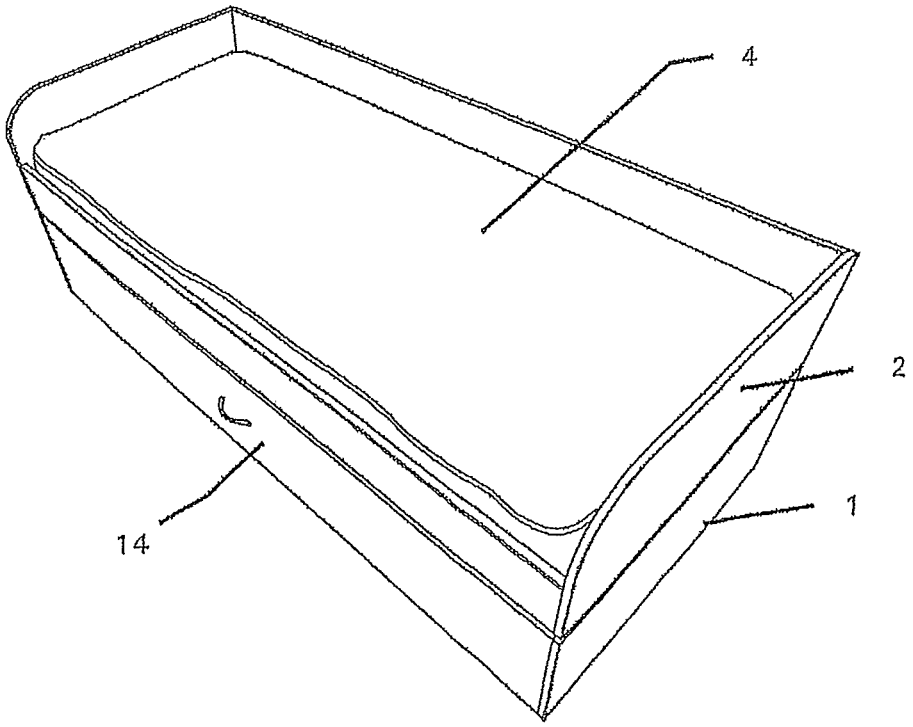
FIG. 1 shows a bed frame according to the invention in its state as a single bed.

FIG. 1 shows the bed frame in its state as a single bed, in which the second mattress 4 can be used. The second frame part 2 is located on top of the first frame part 1. The mattress of the first frame part 1 is hidden.

Figure 2:
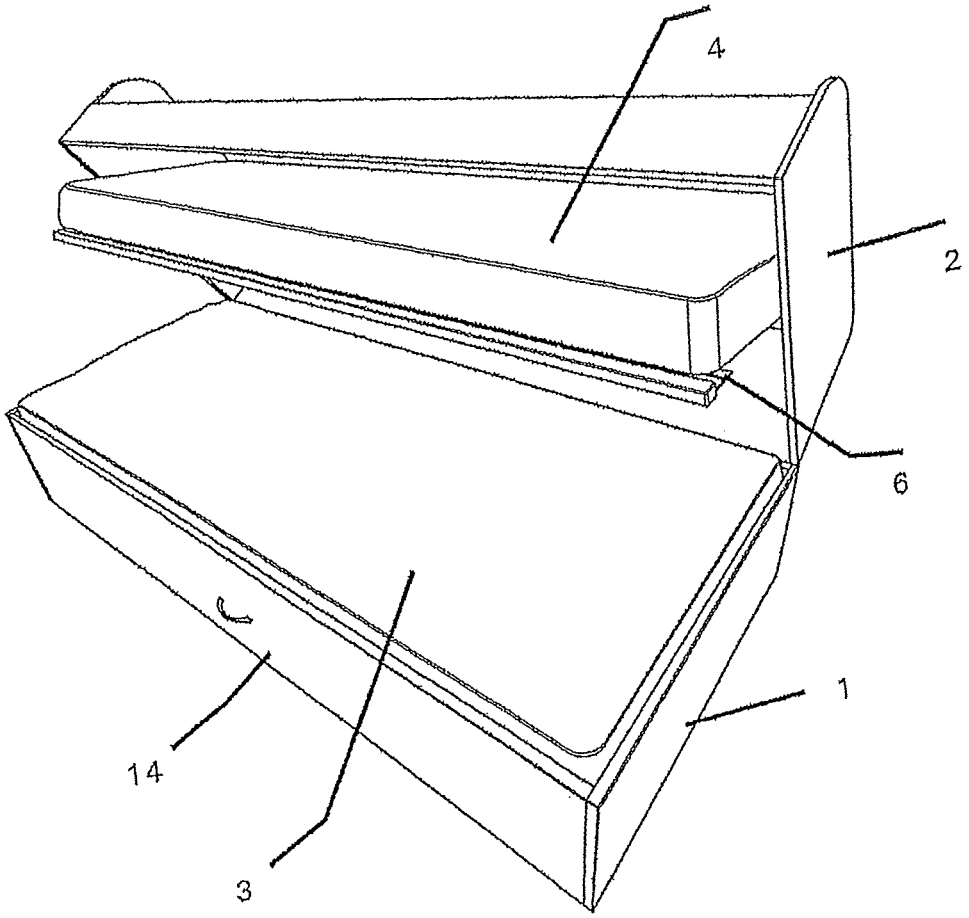
FIG. 2 shows the bed frame according to the invention from the preceding figure during the switching from a single to a double bed.

FIG. 2 shows a state during the switching from a single to a double bed. The second frame part 2 is folded away from the first frame part 1, in the figures to the right. This reveals the first mattress 3.

Figure 3:
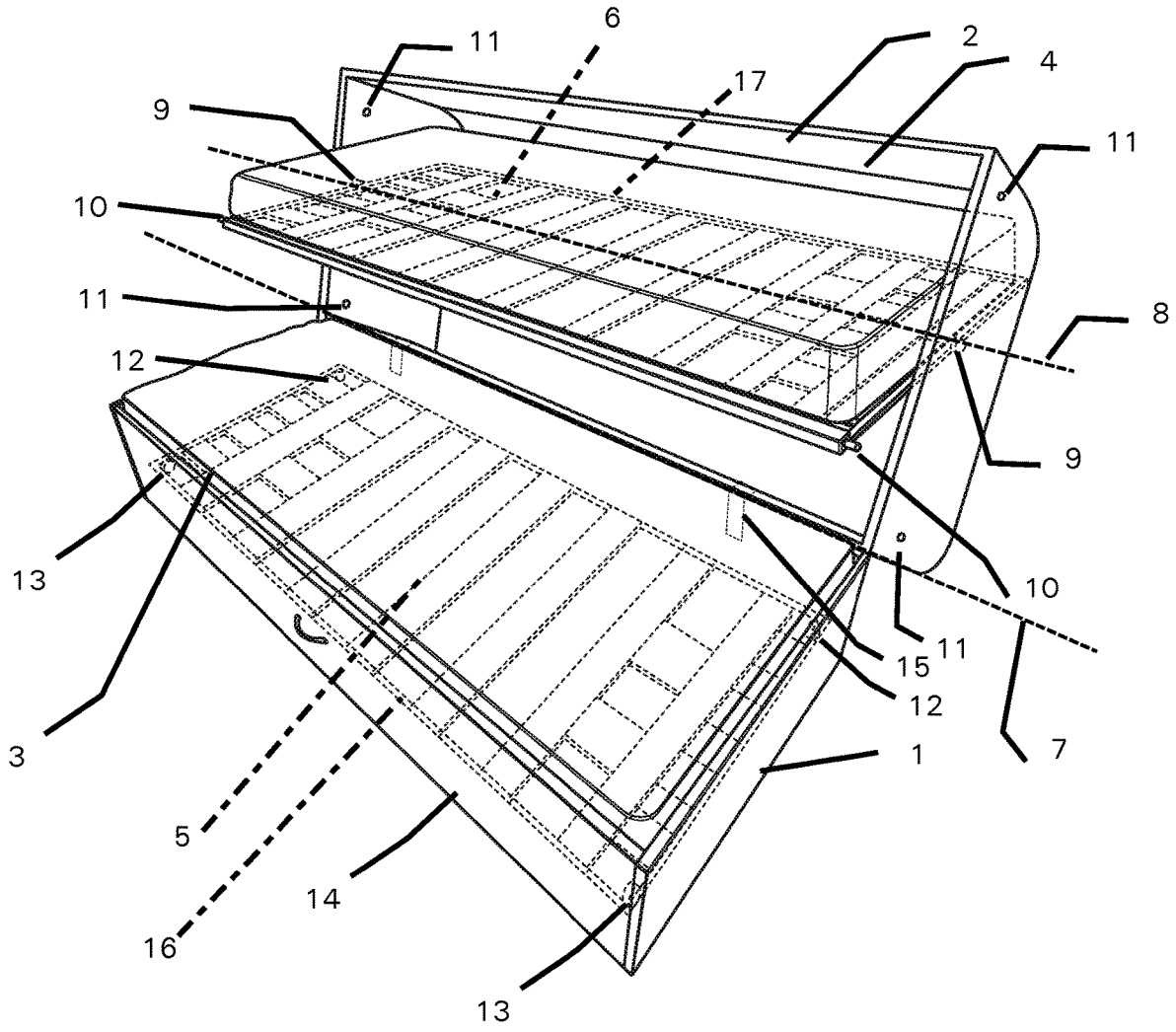
FIG. 3 shows the bed frame according to the invention from the preceding figures during the switching from a single to a double bed, also showing the hidden parts.

FIG. 3 also shows a state during the switching from a single to a double bed, in which the second frame part 2 is folded further. FIG. 3 also makes some hidden parts visible for better explanation of the operating principle.

For example, it shows two hinges 15 which allow folding the second frame part 2 relative to the first frame part 1 about a first axis 7.

Further visible are two slatted frames 5, 6 onto which the mattresses 3, 4 are placed. The first slatted frame 5 is disposed in the first frame part 1 via a first holder 16 and the second slatted frame 6 is disposed in the second frame part 2 via a second holder 17. The second slatted frame 6 is connected to the second frame part by means of two bearings 9 to be rotatable about a second axis 8. The second frame part 2 comprises holes 11 for releasable locking and preventing rotation about the second axis 8. Furthermore, two bolts 10 are provided which can be inserted in the holes for releasable locking and preventing rotation about the second axis 8 in two positions of the second slatted frame 6 relative to the second frame part 2. The bolts 10 and holes 11 together represent two locking devices.

Figure 4:
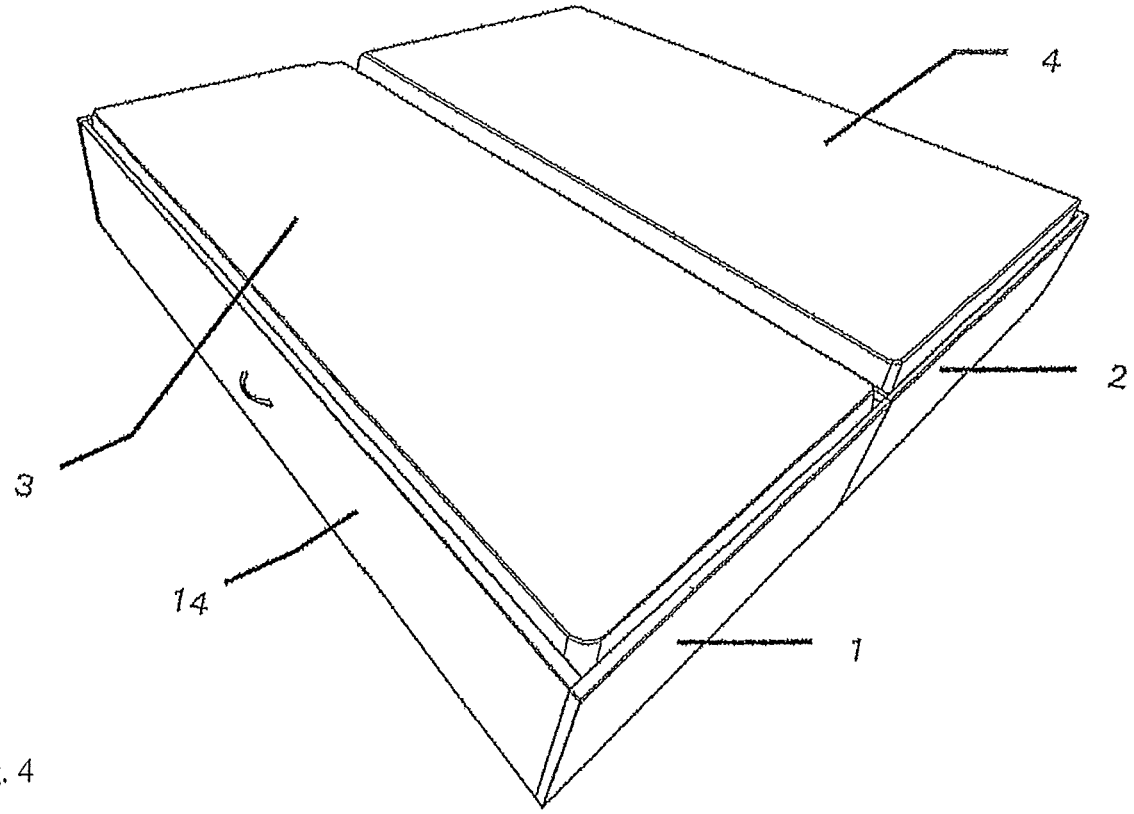
FIG. 4 shows the bed frame according to the invention from the preceding figures in its state as a double bed.

When the second frame part 2 is folded about the first axis 7 from a first position, in which the second frame part 2 is arranged on the first frame part 1, that is, in the state as a single bed as shown in FIG. 1, the second axis 8 moves slightly upwards and sideways, as shown in FIGS. 2 and 3. The second slatted frame 6 can then rotate relative to the second frame part 2 about the second axis 8 and in this way retain its orientation in space even if the second frame part 2 is folded about the first axis 7. The second slatted frame 6 can thus be moved slightly upwards and slightly sideways by folding the second frame part 2, before it is moved slightly downwards and further sideways by a further movement of the second frame part 2. In the second position, the second frame part 2 is arranged adjacent to the first frame part 1, that is, in the state as a double bed, as shown in FIG. 4. The second slatted frame 6 rotated by 180° relative to the second frame part 2 while retaining its orientation in space and is therefore in the second position, as shown in FIG. 4, in an orientation identical with that of the first position, as shown in FIG. 1, adjacent to the first slatted frame 5. In the first and second positions, the orientation of the slatted frame 6 relative to the second frame part 2 can be blocked by locking the locking devices 10, 11 by pushing the bolts 10 into the holes 11. This lock can be released for switching from the first into the second position by moving the bolts 10 out of the holes 11, which allows the rotation of the second slatted frame 6 relative to the second frame part 2 as described above.

The first frame part 1 in addition comprises a pull-out drawer 14 as well as two castors 12 and two releasably lockable castors 13. The castors are each connected rotatably about a vertical axis to the first frame part 1. The lockable castors 13 become accessible when the drawer 14 is pulled out, such that they can be locked and released. Locking prevents the castors from rolling. The bed frame can easily be moved in the room using the castors 12 and the lockable castors 13, but it can also be fixed. This is of particular advantage, since single beds and double beds are typically positioned differently in a room. For example, the single bed can be positioned with its longitudinal side, particularly the longitudinal side on which the first axis 7 is located, against a wall and/or even with two of its sides in a corner, and before or after switching into a double bed it can be rolled into the room to allow or facilitate the switching and/or to allow positioning of the double bed, for example with its head side against a wall, particularly the wall where previously the longitudinal side was positioned. A head side is a side that is adjacent to a longitudinal side, particularly at a right angle.

LIST OF REFERENCE SYMBOLS

1 First frame part
2 Second frame part
3 First mattress
4 Second mattress
5 First slatted frame
6 Second slatted frame
7 First axis
8 Second axis
9 Bearing
10 Bolt
11 Hole
12 Castor
13 Lockable castor
14 Drawer
15 Hinge

The invention claimed is:

1. A bed frame comprising:
a first frame part; and
a second frame part;
wherein the first frame part includes one of:
a first mattress receiving device, and
the first mattress receiving device with a first holder therefor;
and wherein the second frame part includes one of:
a second mattress receiving device, and
the second mattress receiving device with a second holder therefor;
wherein the first and the second frame parts are connected to one another so as to be foldable relative to one another about a first axis, the bed frame being arranged in such a way that:
in a first position of the frame parts, the frame parts, the first and second mattress receiving devices, or the first and second mattress receiving devices with their first and second holders are arranged one above the other as well as congruent and parallel to one another; and
in a second position of the frame parts, the frame parts, the first and second mattress receiving devices, or the first and second mattress receiving devices with their first and second holders are connected to one another and are arranged adjacent and parallel to one another; and wherein a second axis centrally intersects the width of the second holder or of the second mattress receiving device and of the second frame part and wherein the first and second axes are arranged parallel to one another; and
wherein the second holder and/or the second mattress receiving device is connected to the second frame part so as to be rotatable and/or pivotable about the second axis.

2. The bed frame according to claim 1, wherein the first frame part and the second frame part are designed to be foldable relative to one another by at least 180° about the first axis.

3. The bed frame according to claim 1, wherein the first axis is arranged on an edge, in particular a longitudinal edge, of the first frame part and on an edge, in particular a longitudinal edge, of the second frame part.

4. The bed frame according to claim 1, wherein the first mattress receiving device is a slatted frame and/or the second mattress receiving device is a slatted frame.

5. The bed frame according to claim 1, wherein the first frame part is a bed frame and/or the second frame part is a bed frame and in particular the first frame part is formed circumferentially around the first mattress receiving device and in particular in the plan view is rectangular and/or in particular the second frame part is formed circumferentially around the second mattress receiving device and in particular in the plan view is rectangular.

6. The bed frame according to claim 1, wherein the first axis extends parallel to a longitudinal extension of the first frame part and/or the second frame part.

7. The bed frame according to claim 1, wherein the bed frame is so arranged that in the first position of the frame parts the first and second mattress receiving devices are arranged one above the other at a distance of 10 to 50 cm, and in particular in the second position of the frame parts the first and second mattress receiving devices are arranged side by side in one plane, in particular with frame part edges between them adjacent to each other.

8. The bed frame according to claim 7, arranged so that the second mattress receiving device in the first position and in the second position has the same orientation in space.

9. The bed frame according to claim 1, comprising at least one locking device for releasably fixing the second holder and/or the second mattress receiving device relative to the second frame part.

10. The bed frame according to claim 1, wherein the first frame part has wheels, in particular four wheels, two of which in particular are designed to be lockable and/or brakeable.

* * * * *